United States Patent [19]

Pier

[11] 3,937,429

[45] Feb. 10, 1976

[54] APPARATUS FOR DETECTING HOT JOURNAL BOXES

[75] Inventor: Jerome R. Pier, Bonita, Calif.

[73] Assignee: Westinghouse Air Brake Company, Wilmerding, Pa.

[22] Filed: May 20, 1974

[21] Appl. No.: 471,209

[52] U.S. Cl. ..... 246/169 A; 116/114.5

[51] Int. Cl.[2] ..... B61K 9/06

[58] Field of Search ..... 246/169 A, 169 R, 182 A, 246/182 B; 340/182, 228, 269, 231; 116/DIG. 38, 114.5; 200/61.08; 303/3, 15, 20, 81

[56] References Cited

UNITED STATES PATENTS

| | | | |
|---|---|---|---|
| 2,429,817 | 10/1947 | Jones | 340/231 |
| 2,628,344 | 2/1953 | Johnson et al. | 246/169 A X |
| 3,248,539 | 4/1966 | Strandt et al. | 246/169 A |
| 3,756,665 | 9/1973 | Ryan | 303/81 |

FOREIGN PATENTS OR APPLICATIONS

| | | | |
|---|---|---|---|
| 195,665 | 4/1965 | Sweden | 246/169 R |

*Primary Examiner*—Trygve M. Blix
*Assistant Examiner*—Stephen G. Kunin
*Attorney, Agent, or Firm*—R. W. McIntire, Jr.

[57] ABSTRACT

A system for each car of a railway train for detecting a hot journal box or boxes on the car by utilizing the heat of the overheated journal box to produce electrical current which, when a sufficient degree is transmitted through appropriate electrical devices to an explosive bolt placed in the brake pipe, causes the bolt to be exploded and thereby open a vent in the brake pipe to atmosphere to effect a brake application on the train. The sound of the escaping air from the brake pipe is used to determine the particular car on which the overheated journal box is located.

7 Claims, 1 Drawing Figure

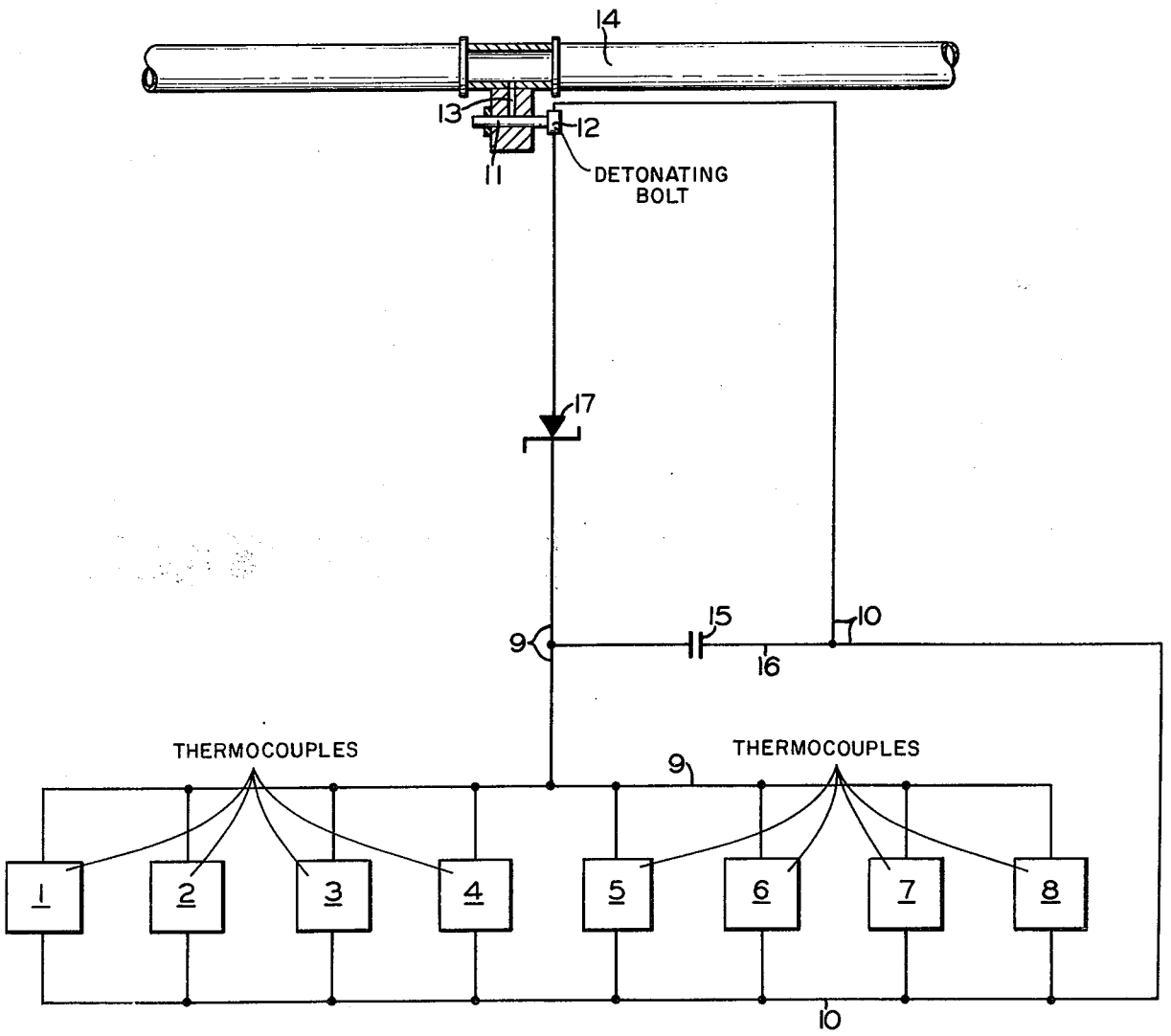
DETONATING BOLT
THERMOCOUPLES
THERMOCOUPLES
1
2
3
4
5
6
7
8
9
10
11
12
13
14
15
16
17

APPARATUS FOR DETECTING HOT JOURNAL BOXES

BACKGROUND OF THE INVENTION

Overheated journal boxes on a railway vehicle in a train may cause the axle to freeze against rotation and possibly result in derailment of the train. Present systems for detecting overheated journal bearings are usually wayside oriented, thereby providing only a periodic check of the journal boxes on the cars as the train passes specific locations at which the wayside detection equipment is located. Moreover, brakeinduced wheel heat may influence wayside detecting devices and cause a false indication accompanied by unnecessary train delays while attempting to locate the hot journal box.

SUMMARY OF THE INVENTION

The object of the present invention is to provide a simplified, low-cost, vehicle-mounted detection system for sensing an overheated axle journal bearing, capable of effecting an automatic application of the brakes when such an overheated bearing is detected, and providing means for immediately locating the car on which the overheated bearing is.

Briefly, the invention comprises respective thermocouples associated with each of the axle journals of a railway car and connected in parallel relation to a capacitor. Heat of the axle journal or bearing is converted to an electrical current which is transmitted to the capacitor. When the voltage potential of the current thus supplied to the capacitor exceeds the threshold level of a zener diode connected to the capacitor, said diode breaks down to provide conducting means via which such current is transmitted to an explosive device connected to the brake pipe. The explosive device is thus detonated to cause a vent in the brake pipe to be opened to atmosphere, thereby, in well known manner, automatically effecting a brake application on the train. The car having the overheated journal can be easily located by the sound of escaping air from the opening in the brake pipe made by the exploding bolt.

The single FIGURE drawing is a schematic view of the apparatus for detecting hot journal boxes on any car of a railway train.

DESCRIPTION & OPERATION

Each of the cars of a train is intended to be equipped with the apparatus shown in the drawing, which comprises a plurality of thermocouples 1, 2, 3, 4, 5, 6, 7, and 8, shown symbolically and associated with each of the journal boxes of each of the axles on a railway car, in this case, four axles or eight journals. Thermocouples 1 through 8 are connected in parallel relation in an electrical circuit comprising conductors 9 and 10 and in which an explosive type member or bolt 11 having an electrically responsive detonating head 12 is serially connected.

Bolt 11 is so disposed as to normally block an atmospheric vent or passageway 13 opening into a brake pipe 14, thereby preventing escape of fluid pressure from said brake pipe to atmosphere.

A capacitor 15 interposed in an interconnecting conductor 16 is connected between conductors 9 and 10 in parallel relation to detonating head 12 and a zener diode 17 which is serially interposed in conductor 9 between capacitor 15 and said detonating head.

As is well known to those skilled in the art, zener diode 17 maintains the electrical circuit open until the potential across capacitor 15 attains a value at which the voltage supplied thereby to said diode exceeds the voltage breakdown threshold of the diode, whereupon said diode causes the circuit to be closed to allow electrical current to flow to detonating head 12 of explosive bolt 11.

In operation, each of the thermocouples 1 through 8, in well known manner, is responsive to heat generated by the respective journals, with the train in motion, to generate electrical current characterized by a voltage commensurate with the degree of heat. If one or more of the journals heats up to and in excess of a certain degree considered dangerous to continued running of the train, such heat causes the respective thermocouples associated with the overheated journal or journals to establish a potential across capacitor 15 sufficient for causing breakdown of zener diode 17 and thereby supply of electrical current to detonating head 12, which thereby causes bolt 11 to be exploded.

When bolt 11 has been exploded, passageway 13 is unblocked and brake pipe 14 is thereby vented to atmosphere. With brake pipe 14 vented to atmosphere and a consequent reduction of fluid pressure therein, a brake application on the train is automatically effected in well known manner.

The car having the overheated journal or journals can readily be located by locating the sound of escaping pressure through passageway 13.

It should be apparent that the flow capacity of passageway 13 determines the rate at which fluid pressure reduction is effected in brake pipe 14 when bolt 11 is exploded, and therefore said flow capacity may be preselected to provide either a service brake application or an emergency application, as desired.

Having now described the invention what I claim as new and desire to secure by letters patent, is:

1. Apparatus for detecting overheated axle journals on a railway car having a brake pipe, said apparatus comprising:

a. an explosive member interposed in and for normally blocking a passageway via which the brake pipe may be vented to atmosphere;

b. a detonating element carried by said explosive member and responsive to an energy charge for effecting explosion of the explosive member;

c. generating means carried by the axle journal and responsive to heat produced by said journal during rotation of the axle for generating an energy charge of a degree commensurate with the degree of prevailing journal heat; and d. transmitting means for transmitting said energy charge to said detonating element when the energy charge so generated exceeds a certain preselected degree.

2. Apparatus for detecting overheated axle journals, as set forth in claim 1, wherein said energy charge comprises an electrical current.

3. Apparatus for detecting overheated axle journals, as set forth in claim 2, wherein said generating means comprises respective thermocouples carried by each of the axle journals for generating said electrical current.

4. Apparatus for detecting overheated axle journals, as set forth in claim 3, wherein said transmitting means includes an electrical circuit for transmitting said electrical current from said thermocouples to said detonating element.

5. Apparatus for detecting overheated axle journals, as set forth in claim 4, wherein said thermocouples are connected in parallel relation to each other in said circuit.

6. Apparatus for detecting overheated axle journals, as set forth in claim 4, wherein said transmitting means further comprises:

a. a zener diode interposed serially in said circuit between said thermocouples and said detonating element; and b. a capacitor connected in said circuit to said thermocouples and in parallel relation to said zener diode and said detonating element.

7. Apparatus for detecting overheated axle journals, as set forth in claim 6, wherein said zener diode is characterized by a voltage breakdown threshold of a predetermined degree.

* * * * *